US006705283B1

(12) United States Patent
Pontoppidan

(10) Patent No.: US 6,705,283 B1
(45) Date of Patent: Mar. 16, 2004

(54) THROTTLE BODY COMPRISING A BUTTERFLY WITH A SPOT FACE

(75) Inventor: Michaël Pontoppidan, Colombes (FR)

(73) Assignee: Magneti Marelli France, Nanterre (FR)

( * ) Notice: Subject to any disclaimer, the term of this patent is extended or adjusted under 35 U.S.C. 154(b) by 29 days.

(21) Appl. No.: 10/110,551

(22) PCT Filed: Nov. 6, 2000

(86) PCT No.: PCT/FR00/03079

§ 371 (c)(1),
(2), (4) Date: Apr. 12, 2002

(87) PCT Pub. No.: WO01/34958

PCT Pub. Date: May 17, 2001

(30) Foreign Application Priority Data

Nov. 10, 1999 (FR) ..... 99 14128

(51) Int. Cl.[7] ..... F02D 9/10
(52) U.S. Cl. ..... 123/337; 251/305; 261/65
(58) Field of Search ..... 123/337; 251/305; 261/62, 65

(56) References Cited

U.S. PATENT DOCUMENTS 3,298,677 A 1/1967 Anderson ..... 261/62
5,881,995 A * 3/1999 Tse et al. ..... 251/305

FOREIGN PATENT DOCUMENTS

| | | | |
|---|---|---|---|
| DE | 197 14 717 | | 4/1998 |
| EP | 0 076 612 | | 4/1983 |
| FR | 1344121 A | * | 2/1964 |
| JP | 59 16 0048 | | 9/1984 |
| JP | 11 294 199 | | 10/1999 |

* cited by examiner

*Primary Examiner*—Tony M. Argenbright
(74) *Attorney, Agent, or Firm*—Sturm & Fix LLP

(57) ABSTRACT

Separated air flow in the neighborhood of the leading edge of a butterfly valve plate in a throttle body fuel injection system can result in whistling. To alleviate the noise, a provided with an recess, or relief, on the suction side of the butterfly valve plate, near the leading edge. The recess has sides that are substantially radial lines starting at the outer periphery of the valve plate and extending toward the center of the valve plate. At their centermost ends, they are connected by a substantially straight line running parallel to the axis of rotation of the butterfly valve plate.

8 Claims, 1 Drawing Sheet

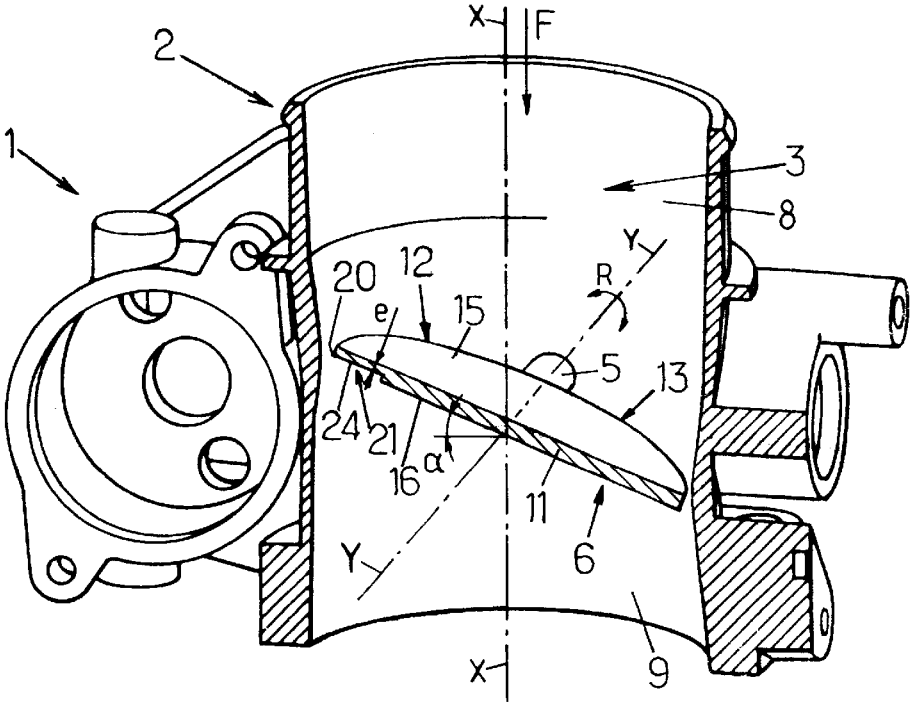
FIG.1.
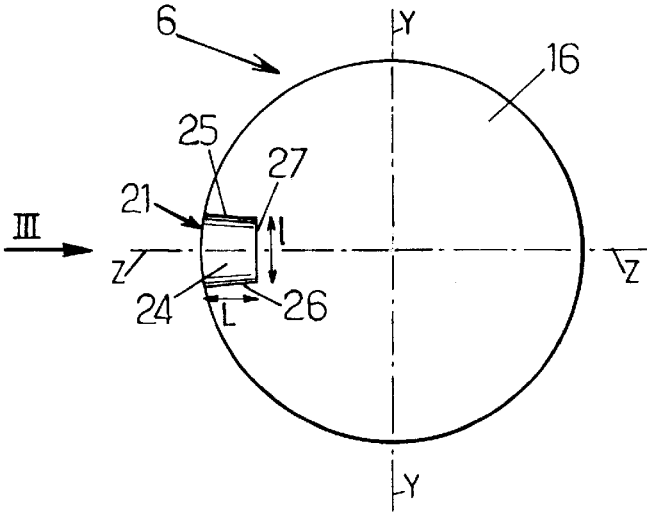
FIG.2.
FIG.3.
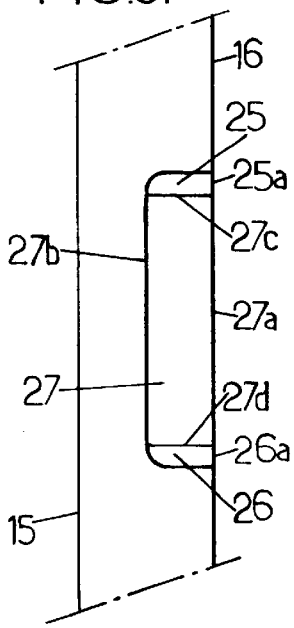

THROTTLE BODY COMPRISING A BUTTERFLY WITH A SPOT FACE

BACKGROUND OF THE INVENTION

1. Field of the Invention

The present invention relates to a throttle body for a fuel injection device for an internal combustion engine.

More specifically, the invention relates to a throttle body of the type comprising:

a housing in which an air inlet duct is formed, and a butterfly in the form of a substantially circular or slightly elliptical disk mounted on a central rotation spindle transversal to the duct, splitting this duct into an upstream part and a downstream part and movable between a minimally open position and a wide open position for which the plane of the butterfly is oriented substantially parallel to the axis of the inlet duct, the part of the butterfly which rotates toward the upstream part of the duct and the part which rotates toward the downstream part, from the minimally open position, being known respectively as the upper wing and the lower wing and having the shape of a flat half-disk having an edge face of small thickness with respect to its area, the upper wing thus having an upstream face and a downstream face, the duct being intended to have passing through it a stream of gas the velocity of which is at a maximum as it passes a portion of the upper wing of the butterfly.

2. Background Art

The gas deflected by the butterfly has a velocity gradient which reaches a maximum over a certain portion of the upper wing of the butterfly. This may give rise to a whistling effect at certain angles of opening of the butterfly when the stream of gas is deflected sharply downstream of the butterfly, for example by a wall of the inlet manifold positioned in close proximity to the outlet of the housing, this being true irrespective of the known shapes of butterfly.

SUMMARY OF THE INVENTION

The object of the present invention is to provide a throttle body in which this kind of whistling is eliminated irrespective of the angle of opening of the butterfly.

To this end, according to the invention, a throttle body of the type in question is essentially characterized in that a recessed relief is formed in the downstream face of the portion of the upper wing of the butterfly which experiences the maximum gas velocity, the recessed relief opening radially into the peripheral lateral face of the butterfly and being delimited by surfaces of which the intersections with the downstream face are sharp edges.

By virtue of these provisions, the recessed relief dissipates some of the energy of the stream of gas which flows over the butterfly so that the energy available for producing audible noise is greatly reduced and the whistling is therefore eliminated, whatever the angle of opening of this butterfly.

In preferred embodiments of the present invention, recourse is further had to one and/or more of the following arrangements:

the recessed relief is delimited by an upper face from which there extend, as far as the downstream face, two substantially radial faces substantially facing each other, and a transverse face connecting the substantially radial faces together and which are such that the intersections of the substantially radial faces and the transverse face with the downstream face are sharp edges, the upper face, the substantially radial faces and the transverse face are substantially flat.

the intersections of the transverse face with the substantially radial faces and the upper face are sharp edges, the substantially radial faces are connected to the upper face with a rounded shape, the substantially radial faces diverge from one another from the transverse face and toward the peripheral lateral face of the butterfly, the upper face of the recessed relief is substantially parallel to the downstream face and the upstream face, of which the intersections with the peripheral lateral face of the butterfly are sharp edges, at the recessed relief, the remaining thickness of the butterfly is less than about 1.5 mm, the width of the recessed relief, considered in a substantially circumferential direction, is substantially between 10% and 25% of the diameter of the butterfly, and the length of the recessed relief, considered in a substantially radial direction, is greater than about 50% of the width of said relief, and the length of the recessed relief is less than about 90% of the width of said relief.

Other features and advantages of the invention will become apparent in the course of the following description of one of its embodiments, which is given by way of nonlimiting example, with reference to the appended drawings.

BRIEF DESCRIPTION OF THE DRAWINGS

FIG. 1 is a view in longitudinal section of a throttle body comprising a butterfly according to the present invention, FIG. 2 is a view from beneath of the butterfly of FIG. 1, and FIG. 3 is an enlarged partial schematic view, on arrow III of FIG. 2, of the butterfly in side elevation facing onto the opening of the recessed relief in the peripheral lateral face of the butterfly.

BEST MODE FOR CARRYING OUT THE INVENTION

FIG. 1 depicts a throttle body 1 which comprises a housing 2 in which an inlet duct 3 of longitudinal axis X—X is formed. The housing 2 is, for example, manufactured by molding in a synthetic material such as a thermoplastic, and obtained in its definitive shape without additional machining or additional deburring. This housing may alternatively be made of aluminum.

In the housing 2, a pivot 5, of axis Y—Y perpendicular to the longitudinal axis X—X of the duct 3 and intersecting this axis X—X, is mounted so that it can rotate and constitutes a central rotation spindle for a butterfly 6 in the form of a flat disk of cross section (perpendicular to the axis of the disk) approximately circular or slightly elliptical, with an upper face and a lower face which are substantially flat and substantially parallel to one another, and of which the intersections with a peripheral lateral face that connects them to each other are sharp edges.

The central rotation spindle 5 is mounted to rotate, for example, mid-way up the duct 3 and splits this duct into two portions 8 and 9. As the duct 3 has a stream of gas passing through it in the direction of the arrow F, for example, the portion 8 is, by convention, known as the upstream portion and the portion 9 is known as the downstream portion.

The butterfly 6 depicted in FIGS. 1 to 3 is advantageously made of a synthetic material such as a thermoplastic. It consists of a flat disk which in plan view is of substantially circular or slightly elliptical shape, of generally constant thickness which means that it has an edge face 11 of substantially constant height around the entire periphery of the disk. Because of technological constraints and because of the pressure exerted by the gases on the butterfly 6, its thickness is, for example, substantially equal to 3 mm at least.

The butterfly 6 pivots about its central rotation spindle 5 in the direction of the double-headed arrow R depicted in FIG. 1, between a minimally open position and a wide open position. In FIG. 1, the butterfly 6 is depicted in an intermediate position of openness. This butterfly may thus be considered as consisting of two half-disks 12 and 13, the half-disk 12 rotating toward the upstream part 8 of the duct 3 being known as the upper wing and the half-disk 13 rotating toward the downstream part 9 of this duct being known as the lower wing. The upper wing 12 has a face 15 known as the upstream face, facing toward the incoming stream, and an opposite face 16 known as the downstream face which faces toward the outgoing stream.

The distribution of the gas velocity gradient across the duct 3 dictates that a portion 20 of the trailing edge of the upper wing 12 experiences a maximum gas velocity. In this portion, the energy of the stream is therefore very high.

According to the present invention, at this portion 20, a single recessed relief 21 is made in the downstream face 16 of the upper wing 12. This relief 21 opens into the downstream face 16 and into the peripheral lateral face of the butterfly 6, extending through part of the thickness of this butterfly.

The recessed relief 21 is in the form of a spot face of substantially rectangular shape and extending substantially radially. Its axis of symmetry Z—Z coincides for example with the diameter of the butterfly and is perpendicular to the axis Y—Y. This is because when no obstacle lies upstream of the butterfly 6 in the duct 3, the plane of maximum gas velocities passes along the diameter of the butterfly 6 which is perpendicular to the axis of rotation Y—Y. However, when the duct 3 has an obstacle upstream of this butterfly 6, the plane of maximum velocities passes through a different place which means that the recessed relief 21 then lies in a different region of the downstream face 16 of the upper wing 12 of the butterfly 6. An essential characteristic is that this relief 21 always lies in the plane of maximum velocity.

In this instance, the depth of the recessed relief 21 is such that the remaining thickness e of the butterfly 6 in the region 20 is less than 1.5 mm.

Furthermore, the recessed relief 21 is delimited by an upper face 24 which is substantially flat and substantially parallel to the downstream face 16, and from which there extend, as far as the downstream face 16, two substantially radial faces 25, 26 substantially facing each other, and a transverse face 27, which are also substantially flat, this face 27 connecting the radial faces 25 and 26 together and being substantially parallel to the axis of rotation Y—Y.

The intersections of the faces known as the radial faces 25, 26 and of the transverse face 27 with the downstream face 16 are all sharp edges 25*a*, 26*a* and 27*a*. Likewise, the intersections of the transverse face 27 with the faces known as the radial faces 25, 26 and with the upper face 24 may be sharp edges 27*c*, 27*d* and 27*b*.

The width l of the recessed relief 21, considered in a substantially circumferential direction, that is to say its dimension along the transverse face 27, is substantially between 10% and 25% of the value of the diameter of the butterfly 6. As to the length L of this relief 21, considered in the substantially radial direction, that is to say its dimension along the faces known as the radial faces 25, 26, this is between about 50% and 90% of the width l. Typically, the width l is approximately equal to 6 mm and the length L is approximately equal to 5 mm while the depth of this relief 21 is substantially constant and approximately equal to 1 mm. The portion 20 of the upper wing 12 is of greatly reduced thickness by comparison with the thickness of the remainder of the butterfly 6, and in this instance of the order of two-thirds to half the thickness of the remainder of the butterfly 6.

Thus, the presence of the recessed relief 21 as defined hereinabove causes a reduction in the energy of the gas stream flowing over the butterfly 6 so that any whistling, which would typically arise at an angle of opening $\alpha$ of the butterfly 6 of between 13° and 21°, is eliminated.

As an alternative, the faces 25 and 26 may be substantially parallel to one another, alternatively may diverge, to an extent different than the divergence resulting from strictly radial faces, from the transverse face 27 and toward the periphery of the butterfly.

In yet another alternative form, the faces known as the radial faces 25 and 26 are connected to the upper face 24 of the relief 21 with rounded edges. This goes even further toward eliminating the whistling.

Sometimes, for space reasons, obstacles are located in the downstream part 9 of the duct 3. It is then preferable for the butterfly 6 to be situated away from these obstacles by a distance equal at least to its diameter and preferably to 1.5 times its diameter.

What is claimed is:

1. Throttle body for a fuel injection device for an internal combustion engine, comprising:

a housing in which an air inlet duct is formed, and a butterfly in the form of a substantially circular or slightly elliptical disk mounted on a central rotation spindle transversal to the duct, splitting this duct into an upstream part and a downstream part and movable between a minimally open position and a wide open position for which the plane of the butterfly is oriented substantially parallel to the axis of the inlet duct, the part of the butterfly which rotates toward the upstream part of the duct and the part which rotates toward the downstream part, from the minimally open position, being known respectively as the upper wing and the lower wing and having the shape of a flat half-disk having an edge face of small thickness with respect to its area, the upper wing thus having an upstream face and a downstream face, the duct being intended to have passing through it a stream of gas the velocity of which is at a maximum at a portion of the upper wing of the butterfly, a recessed relief being formed in the downstream face of the portion of the upper wing of the butterfly which experiences the maximum gas velocity, the recessed relief opening radially into the peripheral lateral face of the butterfly and being delimited by an upper face from which there extend, as far as the downstream face, two substantially radial faces substantially facing each other, of which the intersections with the downstream face are sharp edges, wherein the recessed relief is also delimited by a transverse face connecting the substantially radial faces together and which is such that the intersection of the transverse face with the downstream face is also a sharp edge.

2. The throttle body of claim 1, wherein the upper face, the substantially radial faces and the transverse face are substantially flat.

3. The throttle body of claim 1 or 2, characterized in that the intersections of the transverse face with the substantially radial faces and the upper face are sharp edges.

4. The throttle body of claim 1 or 2 wherein the substantially radial faces are connected to the upper face with a rounded shape.

5. The throttle body of claim 1 or 2 wherein the substantially radial faces diverge from one another from the transverse face and toward the peripheral lateral face of the butterfly.

6. The throttle body of claim 1 or 2 wherein the upper face of the recessed relief is substantially parallel to the downstream face and the upstream face, of which the intersections with the peripheral lateral face of the butterfly are sharp edges.

7. The throttle body of claim 1 or 2 wherein, at the recessed relief, the remaining thickness e of the butterfly is less than about 1.5 mm, the width l of the recessed relief, considered in a substantially circumferential direction, is substantially between 10% and 25% of the diameter of the butterfly, and the length L of the recessed relief, considered in a substantially radial direction, is greater than about 50% of the width of said recessed relief.

8. The throttle body of claim 7, wherein the length L of the recessed relief is less than about 90% of the width l of said relief.

* * * * *